US005438140A

United States Patent [19]

Oftring et al.

[11] Patent Number: 5,438,140

[45] Date of Patent: Aug. 1, 1995

[54] PRODUCTION OF NICKELIZED SHAPED ARTICLES

[75] Inventors: Alfred Oftring, Bad Durkheim; Bernd Burkhart, Mutterstadt; Volker Schwendemann, Neustadt; Klaus Glaser, Mannheim, all of Germany

[73] Assignee: BASF Aktiengesellschaft, Ludwigshafen, Germany

[21] Appl. No.: 211,726

[22] PCT Filed: Sep. 21, 1992

[86] PCT No.: PCT/EP92/02180

§ 371 Date: Apr. 28, 1994

§ 102(e) Date: Apr. 28, 1994

[87] PCT Pub. No.: WO93/09275

PCT Pub. Date: May 13, 1993

[30] Foreign Application Priority Data

Oct. 30, 1991 [DE] Germany ..... 41 35 710.8

[51] Int. Cl.[6] ..... C07D 217/00

[52] U.S. Cl. ..... 546/147; 546/151; 546/180; 546/181; 546/341; 204/279; 204/280

[58] Field of Search ..... 205/181, 279, 280; 546/174, 180, 181, 146, 151, 147, 341

[56] References Cited

U.S. PATENT DOCUMENTS 4,457,934 7/1984 Wong ..... 424/263

FOREIGN PATENT DOCUMENTS 1191652 4/1965 Germany .

OTHER PUBLICATIONS

Praktische Galvanotechnik, Eugen G. Lenze Verlag, Saulgau, 4th Edition (no month) 1984, pp. 268 to 271.

*Primary Examiner*—John Niebling

*Assistant Examiner*—Edna Wong

*Attorney, Agent, or Firm*—Oblon, Spivak, McClelland, Maier, & Neustadt

[57] ABSTRACT

Nickelized shaped articles are produced by electrodeposition of nickel from aqueous acidic baths containing as essential constituents one or more nickel salts, one or more inorganic acids and one or more brighteners, the brighteners used being cyclic ammonium compounds I

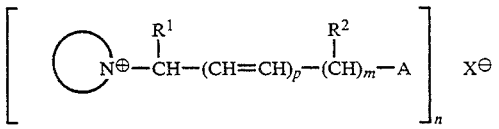

(I)

where the nitrogen atom is part of a pyridine, quinoline or isoquinoline ring system which can additionally carry one or two $C_1$–$C_4$-alkyl substituents, $R^1$ and $R^2$ are each hydrogen or $C_1$–$C_4$alkyl, A is a group of the formula —CO—O—$R^3$, —CO—$CH_2$—CO—O—$R^3$, —O—CO—$R^3$ or —O—$R^3$, where $R^3$ is $C_1$–$C_{12}$-alkyl, $C_5$–$C_8$-cycloalkyl, $C_7$–$C_{12}$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$alkoxycarbonyl groups, m is from 0 to 10, n is from 1 to 4, p is 0 or 1, and $X^{\ominus}$ is an n-valent inorganic or organic anion which promotes water solubility, with the proviso that for p=0 and A=—CO—O—$C_1$–$C_{12}$-alkyl m must not be 1, 2 or 3 and under the same conditions $R^1$ must not be hydrogen when m is 0.

11 Claims, No Drawings

PRODUCTION OF NICKELIZED SHAPED ARTICLES

The present invention concerns an improved process for producing nickelized shaped articles by electrodeposition of nickel from aqueous acidic baths containing as essential constituents one or more nickel salts, one or more inorganic acids and one or more brighteners.

Some of the brighteners used here are new substances. Accordingly, the invention also relates to these new substances.

It is known that acidic nickel electrolytes must contain small amounts of organic substances if the electronickelization is to produce a bright, ductile and surface-planar deposition of the metal. Such brighteners, which in general are divided into primary and secondary brighteners, are customarily used in the form of combinations comprising a plurality of these agents in order to enhance the effect.

Praktische Galvanotechnik, Eugen G. Lenze Verlag, Saulgau, 4th edition 1984, pages 268 to 271 (1) describes customary brighteners for nickel electrolytes. Although the compounds are classified as primary or secondary brighteners or planarizers, it is admitted at the same time that clear-cut classification is not always possible. The brightening compounds mentioned are:

- sulfonimides, eg. benzoic sulfimide
- sulfonamides
- benzenesulfonic acids, eg. mono-, di- and tribenzenesulfonic acid
- naphthalenesulfonic acids, eg. mono-, di- and tri naphthalenesulfonic acid
- alkylsulfonic acids
- sulfinic acid
- aryl sulfone sulfonates
- aliphatic compounds with double and/or triple bonds, eg. butynediol
- single- and multi-ring nitrogen-containing hetero cycles which may contain further hetero atoms such as sulfur or selenium
- coumarin
- amines and quaternary ammonium compounds as planarizing agents
- saccharin.

DE-B-11 91 652 (2) describes single- or multi-ring heterocyclic nitrogen bases of the aromatic type in quaternized form such as pyridinium salts, eg. 2-pyridinium-1-sulfatoethane, as planarizers, ie. brighteners, for acidic nickel-plating baths. These agents are used together with customary basic brighteners such as benzene-m-disulfonic acid, diaryldisulfimides or sulfonamides.

DD 81 548 (3) and DD 108 777 (4) describe pyridiniumacetic acid derivatives of the general formula II

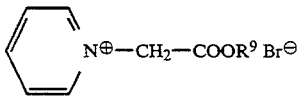

(II)

where $R_9$ is hydrogen, alkyl or alkenyl, as brighteners for the electrodeposition of nickel layers.

FR-A-2 292 057 (5) describes cyclic ammonium compounds of the general formula III

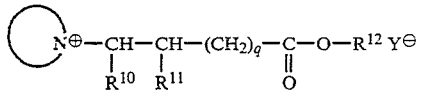

(III)

where $R^{10}$ is hydrogen, methyl, ethyl, propyl, isopropyl, carboxyl or aliphatic carboxylate, $R^{11}$ is hydrogen, methyl, carboxyl or aliphatic carboxylate, $R^{12}$ is the radical of an aliphatic alcohol, q is 0, 1 or 2, and $Y^{63}$ is hydroxide or halide, as brighteners in electroplating baths for the deposition of nickel.

In industry, it is customary to use alkenylsulfonic acid brighteners such as sodium vinylsulfonate or sodium allylsulfonate together with other brighteners such as propargyl alcohol, 2-butyne-1,4-diol, propynesulfonic acid or 3-pyridinium propylsulfonate.

However, the prior art agents generally need to be used in a relatively high concentration in the nickel electrolyte baths used.

The invention has for its object an improved process for producing nickelized shaped articles using brighteners which, while being better than or at least as good as for example 2-pyridinium-1-sulfatoethane, 3pyridinium propylsulfonate of compounds of the general formulae II and III i their brightening, can be used in a lower concentration.

We have found that this object is achieved by a process for producing nickelized shaped articles by electrodeposition of nickel from aqueous acidic baths containing as essential constituents one or more nickel salts, one or more inorganic acids and one or more brighteners, which comprises using brighteners that are cyclic ammonium compounds of the general formula I

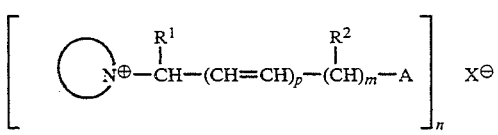

(I)

where the nitrogen atom is part of a pyridine, quinoline or isoquinoline ring system which can additionally carry one or two $C_1$–$C_4$-alkyl substituents, $R^1$ and $R^2$ are each hydrogen or $C_1$–$C_4$-alkyl, A is a group of the formula —CO—O—$R^3$, —CO—$CH_2$—CO—O—$R^3$, —O—CO—$R^3$ or —O—$R^3$, where $R^3$ is $C_1$–$C_{12}$-alkyl, $C_5$–$C_8$-cycloalkyl, $C_7$–$C_{12}$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$-alkoxycarbonyl groups, m is from 0 to 10, n is from 1 to 4, p is 0 or 1, and $X^{\ominus}$ is an n-valent inorganic or organic anion which promotes water solubility, with the proviso that for p=0 and A=—CO—O—$C_1$–$C_{12}$-alkyl m must not be 1, 2 or 3 and under the same conditions $R^1$ must not be hydrogen when m is 0.

Suitable $C_1$–$C_4$-alkyl radicals for $R^1$ and $R^2$ and also for possible substituents on the heterocyclic ring system and on the phenyl ring are n-propyl, isopropyl, n-butyl, isobutyl, sec-butyl, tert-butyl and in particular methyl and ethyl.

Examples of alkyl-substituted heterocyclic ring systems for I are:

2-, 3- or 4-methylpyridinium,
2-, 3- or 4-ethylpyridinium,
3- or 4-n-propylpyridinium,
3- or 4-isopropylpyridinium,
3- or 4-n-butylpyridinium,
4-tert-butylpyridinium,
2,3-, 2,4-, 2,5-, 2,6-, 3,4- or 3,5-dimethylpyridinium,
3-methyl-4-isopropylpyridinium,
4-tert-butyl-3-methylpyridinium,
2-, 3-, 4-, 5-, 6-, 7- or 8-methylquinolinium and
1-, 3-, 4-, 5-, 6-, 7- or 8-methylisoquinolinium.

Preference is given to unsubstituted pyridinium.

Examples of straight-chain or branched $C_1$–$C_{12}$-alkyl radicals for $R^3$ are in addition to the above-mentioned $C_1$–$C_4$-alkyl radicals n-amyl, isoamyl, sec-amyl, tert-amyl, neopentyl, n-hexyl, n-heptyl, n-octyl, 2ethylhexyl, n-nonyl, isononyl, n-decyl, n-undecyl and n-dodecyl. Of these, $C_1$–$C_4$-alkyl radicals are preferred.

Suitable $C_5$–$C_8$,-cycloalkyl radicals for $R^3$ are in particular cyclopentyl, cyclohexyl, cycloheptyl, cyclooctyl, methylcyclopentyl, dimethylcyclopentyl, methylcyclohexyl, dimethylcyclohexyl and ethylcyclohexyl. Of these, cyclopentyl and cyclohexyl are preferred.

Suitable $C_7$–$C_{12}$-phenylalkyl groups for $R^3$ are for example 1-phenylethyl, 2-phenylethyl, 1-phenylpropyl, 2-phenylpropyl, 3-phenylpropyl, 2-phenylpropl-2-yl, 4phenylbutyl, 2,2-dimethyl-2-phenylethyl, 5-phenylamyl, 6-phenylhexyl and in particular benzyl.

If monosubstituted phenyl radical are used for $R^3$,the substitution scheme is ortho, meta or preferably para, while in the case of disubstituted phenyl radicals the substituents are disposed in particular in the 2,4position, for example as in 2,4-xylyl. If substituents are present, a degree of substitution of 1 is preferred. However, unsubstituted phenyl is particularly preferred.

Suitable $C_1$–$C_4$-alkoxy radicals here are in particular methoxy and ethoxy, but also n-propoxy, isopropoxy, n-butoxy, isobutoxy, sec-butoxy and tert-butoxy.

As $C_1$–$C_4$-alkoxycarbonyl groups there may be used here for example n-propoxycarbonyl, isopropoxycarbonyl, n-butoxycarbonyl, isobutoxycarbonyl, sec-butoxycarbonyl, tert-butoxycarbonyl, but in particular ethoxycarbonyl and methoxycarbonyl.

The term halogen atom herein encompasses fluorine, iodine, but in particular bromine and especially chlorine.

The radical $R^1$ is preferably hydrogen, methyl or ethyl, and the radical $R^2$ is preferably hydrogen.

m is preferably from 0 to 8, in particular from to 5.

Suitable n-valent anions X are the customary, normally water-solubilizing inorganic or organic anions, in particular chloride, bromide, fluoride, sulfate, hydrogen sulfate, methanesulfonate, trifluoromethanesulfonate, 2-hydroxyethanesulfonate, p-toluenesulfonate, nitrate, tetrafluoroborate, perchlorate, 1-hydroxyethane-1,1-diphosphonate, dihydrogen phosphate, hydrogen phosphate, formate, acetate, oxalate and tartrate.

Of these, anions with one or two charges (n=1 or 2), primarily fluoride, sulfate, methanesulfonate, nitrate and tetrafluoroborate but in particular chloride and bromide, are preferred.

A preferred embodiment comprises using cyclic ammonium compounds of the general formula Ia

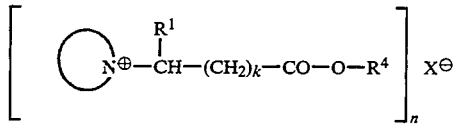

(Ia)

where the variables $R^1$, n and $X^\ominus$ are each as defined above, $R^4$ is $C_1$–$C_{12}$-alkyl or $C_5$–$C_8$-cycloalkyl, and k is 0 or from 4 to 10, with the proviso that $R^1$ is not hydrogen when k is 0.

A further preferred embodiment comprises using cyclic ammonium compounds of the general formula Ib

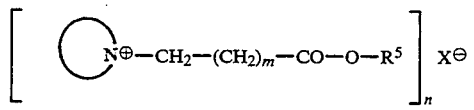

(Ib)

where the variables m, n and $X^\ominus$ are each as defined above and $R^5$ is $C_7$–$C_{12}$-phenylalkyl or phenyl which can be substituted by one or two $C_1$–$C_4$-alkyl radicals.

A further preferred embodiment comprises using cyclic ammonium compounds of the general formula Ic

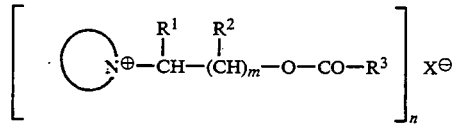

(Ic)

where the variables $R^1$, $R^2$, $R^3$, m, n and $X^\ominus$ are each as defined above.

A further preferred embodiment comprises using cyclic ammonium compounds of the general formula Id

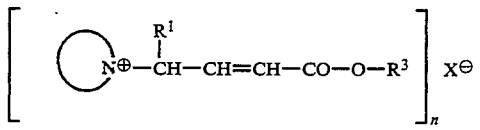

(Id)

where the variables $R^1$, $R^3$, n and $X^\ominus$ are each as defined above.

A further preferred embodiment comprises using cyclic ammonium compounds of the general formula Ie

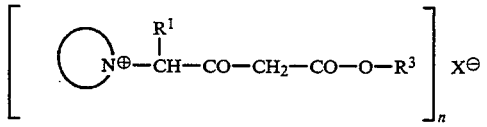

(Ie)

where the variables $R^1$, $R^3$, n and $X^\ominus$ are each as defined above.

A further preferred embodiment comprises using cyclic ammonium compounds of the general formula If

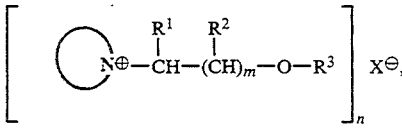

(If)

where the variables $R^1$, $R^2$, $R^3$, m, n and $X^{\ominus}$ are each as defined above.

The cyclic ammonium compounds I used according to the invention are preparable in an advantageous manner by reacting the corresponding precursor of the general formula IV

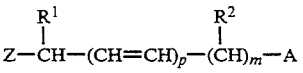

(IV)

where Z is a nucleofugic leaving group, preferably chlorine or bromine, with a heterocycle of the general formula V

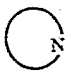

(V)

and if desired subsequently exchanging the anion $Z^{\ominus}$ for $X^{\ominus}$.

The reaction of the components IV and V is advantageously carried out in an inert organic solvent such as toluene, xylene, petroleum ether, ligroin, cyclohexane, acetone, tetrahydrofuran, dioxane, methanol, ethanol, isopropanol, ethyl acetate or methyl benzoate or in a mixture thereof. However, the reaction can also be carried out in water or in a single-phase or two-phase mixture of water and one or more organic solvents, preferably polar organic solvents. In the case of two-phase mixtures it is possible to use a customary phase transfer catalyst. The reaction is in general carried out at from 40°to 130° C., in particular at from 60°to 110° C., and under atmospheric pressure.

Some of the cyclic ammonium compounds I used as brighteners are new substances. Therefore the present application further provides cyclic ammonium compounds of the general formula Ig

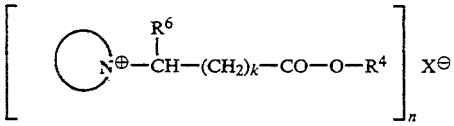

(Ig)

where $R^4$ is $C_{1-C12}$-alkyl or $C_5$–$C_8$-cycloalkyl, k is 0 or from 4 to 10, n is from 1 to 4, $X^{\ominus}$ is an n-valent inorganic or organic anion which promotes water solubility, and $R^6$ is $C_2$–$C_4$-alkyl.

The present application further provides cyclic ammonium compounds of the general formula Ih

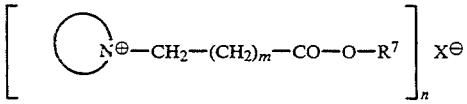

(Ih)

where m is from 0 to 10, n is from 1 to 4, $X^{\ominus}$ is an n-valent inorganic or organic anion which promotes water solubility, and $R^7$ is $C_7$–$C_{12}$-phenylalkyl.

The present application further provides cyclic ammonium compounds of the general formula Ij

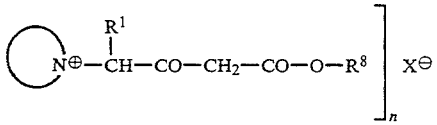

(Ij)

where $R^1$ is hydrogen or $C_1$–$C_4$-alkyl, n is from 1 to 4, $X^{\ominus}$ is an n-valent inorganic or organic anion which promotes water solubility, and $R^8$ is $C_3$–$C_{12}$-alkyl, $C_5$–$C_8$-cycloalkyl, $C_7$–$C_2$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$-alkoxycarbonyl groups.

Since the cyclic ammonium compounds I have the functional characteristics of secondary brighteners, they are preferably used combined with further, normally primary brighteners but if desired also with one or more further secondary brighteners. Examples of suitable primary brighteners are sodium vinylsulfonate and sodium allylsulfonate and of suitable secondary brighteners: 2-butyne-1,4-diol and propargyl alcohol.

The aqueous acidic nickel electrolyte baths used contain one or usually more than one nickel salt, for example nickel sulfate and nickel chloride, one or more inorganic acids, preferably boric acid and sulfuric acid, as brighteners the compounds I alone or preferably combined with other customary brighteners and optionally further customary auxiliaries and additives in the concentrations customary therefor, for example wetting agents and pore inhibitors. Customary aqueous acidic nickel electrolytes ("Watts electrolytes") have the following basic composition:

200–350 g/l of $NiSO_4 \cdot 7\ H_2O$

30–150 g/l of $NiCl_2 \cdot 6\ H_2O$

30–50 g/l of $H_3BO_3$.

The electrolyte bath pH is customarily within the range from 3 to 6, preferably within the range from 4 to 5. This pH is conveniently set with a strong mineral acid, preferably sulfuric acid.

The compounds I are present in the electrolyte baths in low concentrations, in general within the range from 0.04 to 0.5 g/l, preferably within the range from 0.1 to 0.3 g/l. The concentrations of further customary brighteners are normally within the range from in each case 0.1 to 10 g/l, in particular 0.1 to 2.0 g/l.

The nickel electrolyte baths described can be used to produce in particular nickel coatings on shaped articles made of steel, but also on shaped articles made of other materials, for example brass, which have been pretreated as usual, by electroplating. For this the temperatures are in general from 30° to 80° C., preferably from 40° to 60° C.

The compounds I used according to the invention are notable for extremely powerful brightening. In general they produce a greater brightness than the customary brighteners at a distinctly lower concentration in the nickel electrolyte baths.

PREPARATION EXAMPLES

Example 1

Preparation of ethyl 2-pyridiniumbutyrate bromide 7.9 g (0.1 mol) of pyridine and 19.5 g (0.1 mol) of ethyl 2-bromobutyrate were refluxed in 40 ml of acetone for 6 h. Then the solvent was distilled off, and the residue was washed with a little acetone and dried under reduced pressure at about 0.1 mbar. This gave 21.6 g (corresponding to a yield of 79%) of the title compound in the form of colorless crystals. The product was more than 99% pure.

Example 2

Preparation of ethyl 2-pyridiniumacetate bromide

The title compound was prepared as described in Example 1 from pyridine and 2-bromoethyl acetate in a yield of 81%.

Example 3

Preparation of methyl 2-pyridiniumbutyrate bromide

The title compound was prepared as described in Example 1 from pyridine and methyl 2-bromobutyrate in a yield of 85%.

Example 4

Preparation of pentyl 2-pyridiniumpropionate bromide

The title compound was prepared as described in Example 1 from pyridine and pentyl 2-bromopropionate in a yield of 79%.

Example 5

Preparation of ethyl 4-pyridiniumcrotonate bromide

The title compound was prepared as described in Example 1 from pyridine and ethyl 4-bromocrotonate in a yield of 70%.

Example 6

Preparation of methyl 4-pyridiniumcrotonate bromide

The title compound was prepared as described in Example 1 from pyridine and methyl 4-bromocrotonate in a yield of 71%.

Example 7

Preparation of benzyl pyridiniumacetate bromide

The title compound was prepared as described in Example 1 from pyridine and benzyl bromoacetate in a yield of 80%.

Example 8

Preparation of phenyl 3-pyridiniumpropionate chloride

The title compound was prepared as described in Example 1 from pyridine and phenyl 3-chloropropionate in a yield of 86%.

Example 9

Preparation of isopropyl 4 -pyridiniumacetoacetate chloride

The title compound was prepared as described in Example 1 from pyridine and isopropyl 4-chloroacetoacetate in a yield of 71%.

Example 10

Preparation of tert-butyl 4-pyridiniumacetoacetate chloride

The title compound was prepared as described in Example 1 from pyridine and tert-butyl 4-chloroacetoacetate in a yield of 73%.

Example 11

Preparation of methyl 4-pyridiniumacetoacetate chloride

The title compound was prepared as described in Example 1 from pyridine and methyl 4-chloroacetoacetate in a yield of 74%.

Example 12

Preparation of ethyl 4-pyridiniumacetoacetate chloride

The title compound was prepared as described in Example 1 from pyridine and ethyl 4-chloroacetoacetate in a yield of 70%.

Example 13

Preparation of 2-pyridiniumethyl methyl ether bromide

The title compound was prepared as described in Example 1 from pyridine and 2-bromoethyl methyl ether in a yield of 69%.

USE EXAMPLES

The products prepared as described in Examples 1 to 13 were used as brighteners in weakly acidic electroplating baths for the deposition of nickel.

The aqueous nickel electrolyte used had the following composition:

300 g/l of $NiSO_4 . 7 H_2O$
60 g/l of $NiCl_2 . 6 H_2O$
45 g/l of $H_3BO_3$
2 g/l of saccharin
0.8 g/l of sodium vinulsulfonate
x g/l of brightener as per table
0.5 g/l of a fatty alcohol derivative of the formula $C_{12}H_{25}/C_{14}H_{29}—O—(CH_2CH_2O)_2—SO_3Na$ as wetting agent The pH of the electrolyte was set to 4.2 with sulfuric acid.

Brass panels were used. Prior to being coated with nickel they were cathodically degreased in an alkaline electrolyte in a conventional manner. The nickelization took place in a 250 ml Hull cell at 55° C. and a current strength of 2A over a period of 10 minutes. The panels were then rinsed with water and dried with compressed air.

The table below shows the results of these experiments. It can be seen that the brighteners of the invention were more effective in producing brightness than the prior art brighteners, in some instances at a distinctly lower concentration in the nickel electrolyte baths.

TABLE

Test results of electronickelization

| Example No. | Brightener | Concentration × [g/l] | Brightness [rating] |
|---|---|---|---|
| 14 | of Example no. 1 | 0.3 | 5 |
| 15 | of Example no. 2 | 0.2 | 5 |
| 16 | of Example no. 3 | 0.1 | 5 |
| 17 | of Example no. 4 | 0.1 | 5 |
| 18 | of Example no. 5 | 0.15 | 5 |
| 19 | of Example no. 6 | 0.15 | 5 |
| 20 | of Example no. 7 | 0.15 | 5 |
| 21 | of Example no. 8 | 0.3 | 5 |
| 22 | of Example no. 9 | 0.3 | 5 |
| 23 | of Example no. 10 | 0.3 | 5 |
| 24 | of Example no. 11 | 0.3 | 5 |
| 25 | of Example no. 12 | 0.3 | 5 |
| 26 | of Example no. 13 | 0.2 | 5 |
| For comparison | | | |
| A | 2-pyridinium-1-sulfatoethane | 0.3 | 4–5 |
| B | 3-pyridinium propylsulfonate | 0.3 | 4–5 |
| C | methyl pyridiniumacetate chloride | 0.3 | 4 |
| D | tert-butyl pyridiniumacetate chloride | 0.5 | 4 |
| E | methyl 3-pyridinium-3-carboxypropionate chloride | 0.7 | 4 |

Rating scheme for brightness:
5 = excellent (perfect specular gloss)
4 = good (virtually specular gloss)
3 = moderate
2 = poor
1 = no brightness The comparative compounds C and D are known from (3) and (4) respectively and the comparative compound E is known from (5).

We claim:

1. A process for producing nickelized shaped articles, comprising electrodepositing nickel from aqueous acidic baths containing as essential constituents one or more nickel salts, one or more inorganic acids and one or more brighteners, said brighteners being cyclic ammonium compounds of the general formula I

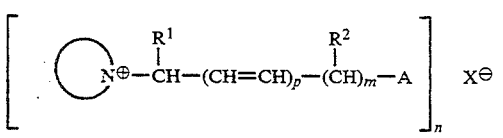

(I)

where the nitrogen atom is part of a pyridine, quinoline or isoquinoline ring system which can additionally carry one or two $C_1$–$C_4$-alkyl substituents, $R^1$ and $R^2$ are each hydrogen or $C_1$–$C_4$-alkyl, A is a group of the formula —CO—$R^3$, —CO—O—$R^3$, —CO—$CH_2$—CO—O—$R^3$, —O—CO—$R^3$ or —O—$R^3$, where $R^3$ is $C_1$–$C_{12}$-alkyl, $C_5$–$C_8$-cycloalkyl, $C_7$–$C_{12}$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$-alkoxycarbonyl groups, m is from 0 to 10, n is from 1 to 4, p is 0 or 1, and $X^\ominus$ is an n-valent inorganic or organic anion which promotes water solubility, with the proviso that for p=0 and A=—CO—O—$C_1$–$C_{12}$-alkyl m must not be 1, 2 or 3 and under the same conditions $R^1$ must not be hydrogen when m is 0.

2. A process for producing nickelized shaped articles as claimed in claim 1, wherein the brighteners are cyclic ammonium compounds of the general formula (Ib)

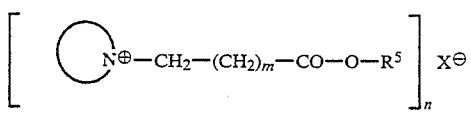

(Ib)

where the variables m, n and $X^\ominus$ are each as defined in claim 1, and $R^5$ is $C_7$–$C_{12}$-phenylalkyl or phenyl which can be substituted by one or two $C_1$–$C_4$-alkyl radicals.

3. A process for producing nickelized shaped articles as claimed in claim 1, wherein the brighteners are cyclic ammonium compounds of the general formula (Ic)

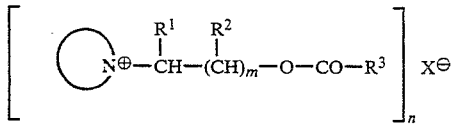

(Ic)

where the variables $R^1$, $R^2$, $R^3$, m, n and $X^\ominus$ are each as defined in claim 1.

4. A process for producing nickelized shaped articles as claimed in claim 1, wherein the brighteners are cyclic ammonium compounds of the general formula (Id)

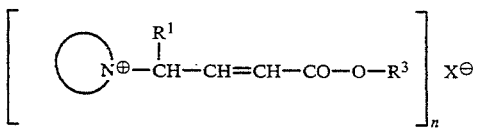

(Id)

where the variables $R^1$, $R^3$, n and $X^\ominus$ are each as defined in claim 1.

5. A process for producing nickelized shaped articles, comprising electrodepositing nickel from aqueous acidic baths containing as essential constituents one or more nickel salts, one or more inorganic acids and one or more brighteners, said brighteners being cyclic ammonium compounds of the general formula (Ie)

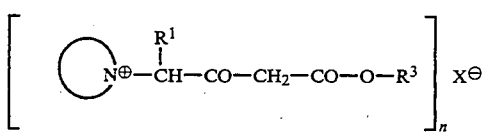

(Ie)

where the nitrogen atom is part of a pyridine, quinoline or isoquinoline ring system which can additionally carry one or two $C_1$–$C_4$-alkyl substituents, $R^1$ is hydrogen or $C_1$–$C_4$alkyl, $R^3$ is $C_1$–$C_{12}$-alkyl, $C_5$–$C_8$-cycloalkyl, $C_7$–$C_{12}$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$-alkoxycarbonyl groups, n is from 1 to 4, and $X^\ominus$ is an n-valent inorganic or organic anion which promotes water solubility.

6. A process for producing nickelized shaped articles as claimed in claim 1, wherein the brighteners are cyclic ammonium compounds of the general formula (If)

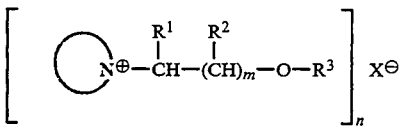

(If)

where the variables $R^1$, $R^2$, $R^3$, m, n and $X^\ominus$ are each as defined in claim 1.

7. A process for producing nickelized shaped articles as claimed in anyone of claims 1–6, wherein in addition to the cyclic ammonium compounds at least one further brightener is used.

8. A process for producing nickelized shaped articles as claimed in claim 1, wherein the brighteners are cyclic ammonium compounds of the general formula (Ia)

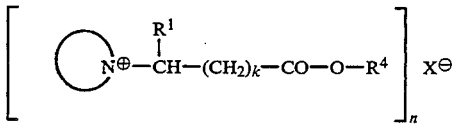

(Ia)

where the nitrogen atom is part of a pryridine, quinoline or isoquinoline ring system which can additionally carry one or two $C_1$–$C_4$-alkyl substituents, the variables $R^1$, n and $X^\ominus$ are each as defined in claim 1, $R^4$ is $C_1$–$C_{12}$-alkyl or $C_5$–$C_8$-cycloalkyl, and k is 0 or 4 to 10.

9. Cyclic ammonium compounds of the general formula Ig

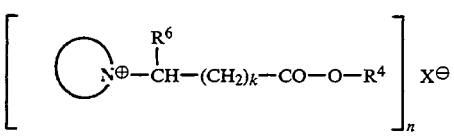

(Ig)

where the nitrogen atom is part of a pyridine, quinoline or isoquinoline ring system which can additionally carry one or two $C_1$–$C_4$-alkyl substituents, $R^4$ is $C_1$–$C_{12}$-alkyl or $C_5$–$C_8$-cycloalkyl, $R^6$ is $C_2$–$C_4$-alkyl, n is from 1 to 4, k is 0 or 4 to 10, and $X^\ominus$ is an n-valent inorganic or organic anion which provides water solubility.

10. Cyclic ammonium compounds of the general formula Ih

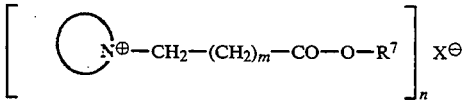

(Ih)

where the nitrogen atom is part of a pyridine, quinoline or isoquinoline ring system which can additionally carry one or two $C_1$–$C_4$-alkyl substituents, $R^7$ is $C_7$–$C_{12}$-phenylalkyl, m is from 0 to 10, n is from 1 to 4, and $X^\ominus$ is an n-valent inorganic or organic anion which provides water solubility.

11. Cyclic ammonium compounds of the general formula Ij

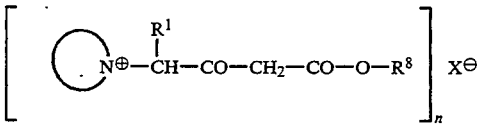

(Ij)

where the nitrogen atom is part of a pyridine, quinoline or isoquinoline ring system which can additionally carry one or two $C_1$–$C_4$-alkyl substituents, $R^8$ is $C_3$–$C_{12}$-alkyl, $C_5$–$C_8$-cycloalkyl, $C_7$–$C_{12}$-phenylalkyl or phenyl which can be substituted by one or two $C_1$–$C_4$-alkyl radicals, $C_1$–$C_4$-alkoxy radicals, halogen atoms, hydroxyl groups, phenyl radicals or $C_1$–$C_4$-alkoxycarbonyl groups, $R^1$ is hydrogen or $C_{1-C4}$-alkyl, n is from 1 to 4, and $X^\ominus$ is an n-valent inorganic or organic anion which provides water solubility.

* * * * *

UNITED STATES PATENT AND TRADEMARK OFFICE

CERTIFICATE OF CORRECTION

PATENT NO. : 5,438,140

DATED : August 1, 1995

INVENTOR(S) : Alfred OFTRING, et al.

It is certified that error appears in the above-indentified patent and that said Letters Patent is hereby corrected as shown below:

On the title page, Item [75], the first inventor's city of residence should read:

--Bad Duerkheim--

Signed and Sealed this

Third Day of October, 1995

*Attest:*

Bruce Lehman

BRUCE LEHMAN

*Attesting Officer*

*Commissioner of Patents and Trademarks*